US006038787A

United States Patent [19]

Dean et al.

[11] Patent Number: 6,038,787

[45] Date of Patent: Mar. 21, 2000

[54] PAINT BRUSH AND ROLLER CLEANING ADAPTER

[75] Inventors: Daniel R. Dean, 106 Silver Shoals, Shell Beach, Calif. 93449; Charles R. DeCola, Nipomo, Calif.

[73] Assignee: Daniel R. Dean, Shell Beach, Calif.

[21] Appl. No.: 09/220,646

[22] Filed: Dec. 24, 1998

[51] Int. Cl.[7] ..... F26B 5/08

[52] U.S. Cl. ..... 34/312; 34/58; 15/246; 134/140; 134/149; 134/900

[58] Field of Search ..... 34/58, 312; 134/900, 134/149, 140, 33, 157; 15/4, 246, 159.1, 105

[56] References Cited

U.S. PATENT DOCUMENTS

| | | | |
|---|---|---|---|
| 2,931,661 | 4/1960 | Harris | 34/58 |
| 3,399,463 | 9/1968 | Sdtott | 34/58 |
| 3,609,051 | 9/1971 | Braun | 401/197 |
| 3,696,457 | 10/1972 | Hand | 15/4 |
| 3,894,807 | 7/1975 | Betz, III | 403/221 |
| 3,925,908 | 12/1975 | Dunn | 34/58 |
| 4,130,443 | 12/1978 | Dulin | 134/33 |
| 4,308,634 | 1/1982 | Eisenberg | 15/142 |
| 4,759,384 | 7/1988 | Kliewer | 134/140 |
| 4,982,471 | 1/1991 | Bannan | 15/105 |
| 5,107,877 | 4/1992 | Chipman | 134/140 |
| 5,185,938 | 2/1993 | Hutt | 34/58 |
| 5,588,221 | 12/1996 | Hoeltke et al. | 34/58 |
| 5,621,979 | 4/1997 | Taylor | 34/58 |
| 5,784,798 | 7/1998 | Taylor | 34/58 |

*Primary Examiner*—James C. Yeung

[57] ABSTRACT

The disclosed invention is an improved means of cleaning paint brushes and paint rollers. The device consists of a base with at least two pliable longitudinal extensions which are held together by a series of ring segments. This combination of extensions and ring segments define a cavity that is capable of receiving and releasably securing the handle of a paint brush. The base is capable of receiving a paint roller, the roller fitting over the longitudinal extensions. An attachment rod extends from the base, opposite to the extensions. The attachment rod can be received by a drill chuck, or other rotary device and thereby rotated, including the brush received therein. As the brush rotates the flexible nature of the extensions allow the brush to orbit about the axis of rotation imparted by the drill. This allows rotation and translation of the brush so that no bristles of the brush are consistently in line with the center of rotation. Thus, all bristles move thereby generating a centrifugal force on the debris enabling a more expedient and thorough cleaning.

20 Claims, 5 Drawing Sheets

PAINT BRUSH AND ROLLER CLEANING ADAPTER

BACKGROUND OF THE INVENTION

1. Field of the Invention

The invention herein relates to the area of hand tools and more specifically to a device that is used to facilitate cleaning of paint brushes and paint rollers.

2. Overview of Prior Art

Attempts have been made in developing devices that are used in cleaning paint brushes and paint rollers. In some cases such devices are used in conjunction with rotary motion such as that supplied by a spinner, such as that disclosed by Hoeltke et al, in U.S. Pat. No. 5,588,221; or a common electric drill. This includes a griping set of jaws that can receive a paint brush handle and an outer sleeve that can receive a paint roller. A plunger is driven by the hand of the user which causes rotary motion of the jaws and sleeve. This rotary motion results in a centrifugal force that results in displacement of the paint from the rollers and much of the paint from the bristles of a brush. Centrifugal force is related to the angular velocity of the paint particle and the distance from the center of rotation. Since the center of rotation of the spinner travels through the brush, some bristles and paint particles thereon will not be effected by this force. Also, the spinner is a machine in and of itself. Not counting the noted deficiency, this device may be practical for some commercial painters but certainly not for the home owner who paints once every few years. A small attachment for some other form of rotary motion, such as a common electric drill, which most homes have anyway, would be much more practical, and for the commercial painter it would mean one less machine to carry.

In response to this demand by the users Dunn has disclosed a version of such a device in U.S. Pat. No. 3,925,908. Here Dunn uses a generally cylindrical device with a shank on one end and the other end open. The shank is used by securing in an electric drill chuck and thereby applying rotary motion to the cylindrical portion of the device. The cylindrical portion includes a set of leaf springs that are supported in the wall of the cylinder, a portion displaced to the inside and a portion displaced to the outside. A paint brush handle can then be secured in the inside of the cylinder and a paint roller on the outside. One of the problems with such a design is that handle size and shapes vary greatly from one maker to another as well as in the size of the brush. With a rigid cylindrical frame the variability of such a device is greatly limited. Also, since the cylindrical frame is not allowed to easily flex the center bristles of the brush will not be adequately cleaned because of the center of rotation of the device will be very close to some bristles. Spinning the brush in the air would result in no centrifugal force because there is no radius to the axis. If the brush is placed in the solvent and rotated the bristles are cleansed by passing them through a great deal of solvent. Only the outside bristles would be cleaned this way. The interior bristles that are aligned with the axis of the device pass through very little solvent. These inside bristles are the most difficult to clean.

A similar device is disclosed by Hutt in U.S. Pat No. 5,185,938 where a mechanical jaw grips the brush handle. This device does address the problem of variability in size of the handles but requires cast or machines parts and as such is expensive to manufacture. In addition paint contamination on the internal threads would likely make the device non-functional. As previously mentioned, the same problem exists with the center bristles not being cleaned. In order for this device to operate due to the mating parts, the cylindrical portion must be rigid. This means that the center of rotation will always pass through an area of bristles of the brush, and that area will not be adequately cleaned.

An attempt to solve some of the aforementioned problems is proposed by Taylor in U.S. Pat. No. 5,621,979 which includes a tapered hollow shank with a spring grip on an open end. The tapered shank is enclosed by a hollow cylindrical body and a spindle for a rotary drive device is on the end opposite to the open end. The spring does eliminate the need for a mechanical clamping device as previously disclosed, but it would seemingly only work well on handles that are cylindrical in shape, such as with artist's paint brushes. Commercial wide brushes typically have handles that have an hour glass shape, larger in the middle than on either end. Due to the variation in shape and handle size this clasping device with only one flexing part would be undesirable and potentially dangerous if a brush was dislodged while spinning at a high speed. In addition, this rigid device is not suited to allow the brush to rotate outside of the center of rotation of the tool, similar to those previously disclosed.

A brush extension handle is disclose by Betz in U.S. Pat. No. 3,894,807 which is comprised of a wooden coupling with tapered threads on one end and a foam rubber sleeve on the there end. This is intended to fit on the end of a handle, by the tapered threads, and the other end can receive a paint brush. This is to extend the users arm to reach difficult spots while painting. The item could conceivably be modified to be attached to a drill chuck and rotated with a brush in the other end, but the same limitations as previously disclosed would exist regarding rotation about the center of the brush. Also it is doubtful as to the security of maintaining the brush in position by a sponge rubber sleeve if the material is pliable enough to conform to the great variability in brush handles to be truly useful.

The problem associated with having the center of rotation not pass through a portion of the bristles was addressed by Kliewer in U.S. Pat. No. 4,759,384 where the brush is mounted orthogonal to the axis of rotation. Though this is addressed numerous other issues now arise, most obviously, safety. Brushes can be of a substantially length and mass. If the brush is not positioned with axis of rotation at or near the center of gravity of the brush the brush could become dislodged while rotating. The resultant projectile could be very damaging to people or property nearby. If the brush is not dislodged, the excessive rotating path would make it easy to inadvertently contact a person or item and thereby cause damage.

Dulin, in U.S. Pat. No. 4,130,443 disclosed a closed unit that is applicable only for paint rollers. This self contained unit includes a motor which drives a journaled shaft which is connected to a support for a paint roller. The device, as disclosed, would not be capable of rotating a paint brush because no attachment means is disclosed nor obvious to support a paint brush. Also, this is a fully enclosed unit that is likely to be expensive to manufacture and bulky to transport, and therefore not practical for most field applications. Since only paint rollers are used, varying the center of rotation is not necessary because a paint roller is hollow. Therefore, there is no paint to be displaced about the center of rotation of a paint roller.

Along the lines of the previously disclosed Hand disclosed a cleaning apparatus in U.S. Pat No. 3,696,457 which includes a carrying case with solvent therein. A rotary attachment is devised to rotate the rollers so that they can be spun dry inside the enclosure. A handle is included which receives the handle of a paint brush and an opening in the top of the container lid allows the brush portion to be inserted therein and physically rotated to dry the brush after soaking in the solvent. It is apparent that it is intended that the user rotate or spin the brush by hand because no mechanism is provided to facilitate this process. As such, the amount of rotational kinetic energy that could be imparted on the brush and handle to free the water and debris from the bristles is far from that necessary to do an adequate job. In addition, the device is primarily a storage device and therefore large and bulky. Thus, the device lacks function and efficiency.

A unique method of cleaning paint brushes is disclosed by Chipman in U.S. Pat. No. 5,107,877 which utilizes an osculating arm which includes one or more brushes clamped thereon. This arm and associated brushes is submerged into a container of solvent and osculated to clean the brushes. It is a self contained unit that is large and would not be efficiently used outside on a commercial painting job. The osculating feature enables a "sloshing" of the solvent. That, in combination with the osculating of the brushes themselves, could cause enough solvent to pass through the bristles to clean them, but it does nothing to dry the brushes. Running the brushes in the absence of the solvent would do virtually nothing to accelerate the process of drying the brushes which is an equally important step. For the aforementioned reasons the device is not practical in a commercial application, and given the expense of manufacturing such a device it is far from optimal in any application.

A tool to facilitate soaking or draining a paint brush is disclosed by Bannan in U.S. Pat. No. 4,982,471. The device includes a notch for receiving a paint brush handle such that the brush can be suspended with the bristles hanging vertically, thereby able to drain into a container or soak in a container of solvent. A cutout is included on one end of the tool to receive and scrape the surface of a roller to aid in cleaning the roller of paint and moisture. No attempt is made to use such a device to facilitate cleaning or drying a paint brush nor for cleaning the roller beyond removing debris by scraping. This is not only less than effective as a process of cleaning and drying but it damages the nap of the roller, thus reducing the life of the roller.

A brush cleaning system is disclosed in U.S. Pat. No. 4,308,634 by Eisenberg which includes a plurality of coils supported by wire elements. The user is intended to drag the bristles of a paint brush along the coils, the interference of the bristles and the coils intending to remove a portion of the paint therefrom. This system is at best marginally effective as a device for "combing" the brush. Some paint would be removed but a great deal of the paint deep within the body of the brush would remain, especially when the coils or the "comb" are covered with paint. Even a small amount of paint left on the bristles to dry will contaminate the brush for future use. In addition this "combing" process is potentially damaging to the bristles of the brush due to the frictional force that removes the paint. For these reasons this device would be less than effective.

No device in the art discloses nor suggests a compact device that can be used with an existing rotary device to spin a paint brush and roller in such a manner that the center of rotation of the brush is not a consistent spot within the brush. This translation allows for a centrifugal force to be applied to all bristles of the brush, not just the outside bristles.

SUMMARY OF THE INVENTION

The object of the disclosed invention is to provide a means of cleaning paint brushes and paint rollers. The device is comprised of a base with two or more pliable longitudinal extensions extending therefrom and defining a cavity there between. The cavity being suited for receiving the handle of a paint brush. The longitudinal extensions are connected one to another by a series of ring segments that are oriented either in a continuous annular ring or displaced such that the segments are not in the same plane. The ring segments are positioned at two or more positions along the longitudinal dimension of the extensions, allowing for gaps there between. These gaps between the ring segments in conjunction with the pliable nature of the extensions allow the extensions to conform to the shape of a variety of handle shapes while firmly grasping same.

An attachment means extends from the base in the opposite direction of the extensions. The attachment means can be of a variety of shapes and dimensions but has been found to be the most desirable in the form of a cylindrical rod. This rod can then be received by an electric drill, pneumatic drill, manual spinner or other form of imparting rotary motion. The pliable nature of the extensions supports a brush positioned therein in a manner that the extensions are allowed to flex as the drill or other rotary device spins the tool and enclosed paint brush. This flexion during rotation provides an inconsistent center of rotation with respect to the brush, thereby ensuring all bristles are at some time a distance from the center of rotation. This distance is the radius that is necessary to enable a centrifugal force to the debris on all bristles to clean same.

A paint roller can be fitted on the base and also cleansed by rotating. The hollow center of the roller does not necessitate flexion of the base.

DETAILED DESCRIPTION OF THE PREFERRED EMBODIMENT

Commercial painters as well as the home handyman all encounter the need to bring out the previously used paint brushes and rollers to be used again. This is of the utmost importance for the professional painter where every day a new paint job or at least a new paint color is a possibility. Brushes and rollers should be cleaned before every long break, i.e. lunch and quitting time for that day. If this is not done the brushes will be damaged or unusable because of the paint left thereon will dry and cake on the bristles of the brush or nap of the roller. Even a change in color means one of two things, either a clean set of brushes and rollers are used or the tradesman purchases new items. For the professional this means an unnecessary cut into the profits of the business. From the cost of purchasing the items themselves to the downtime of commuting to the supply store and back to the job. As a solution, an efficient and effective means of cleaning brushes and rollers is disclosed herein. It is important to note that if the brushes are not cleaned thoroughly, the item is still not usable at a future date because it can contaminate the paint on the next job. Also, when the paint dries in the brush or roller it hardens the bristles making it no longer effective. It must be noted that if any cleaning process is to time consuming the labor cost can outweigh the cost of a new item.

Figure 1:
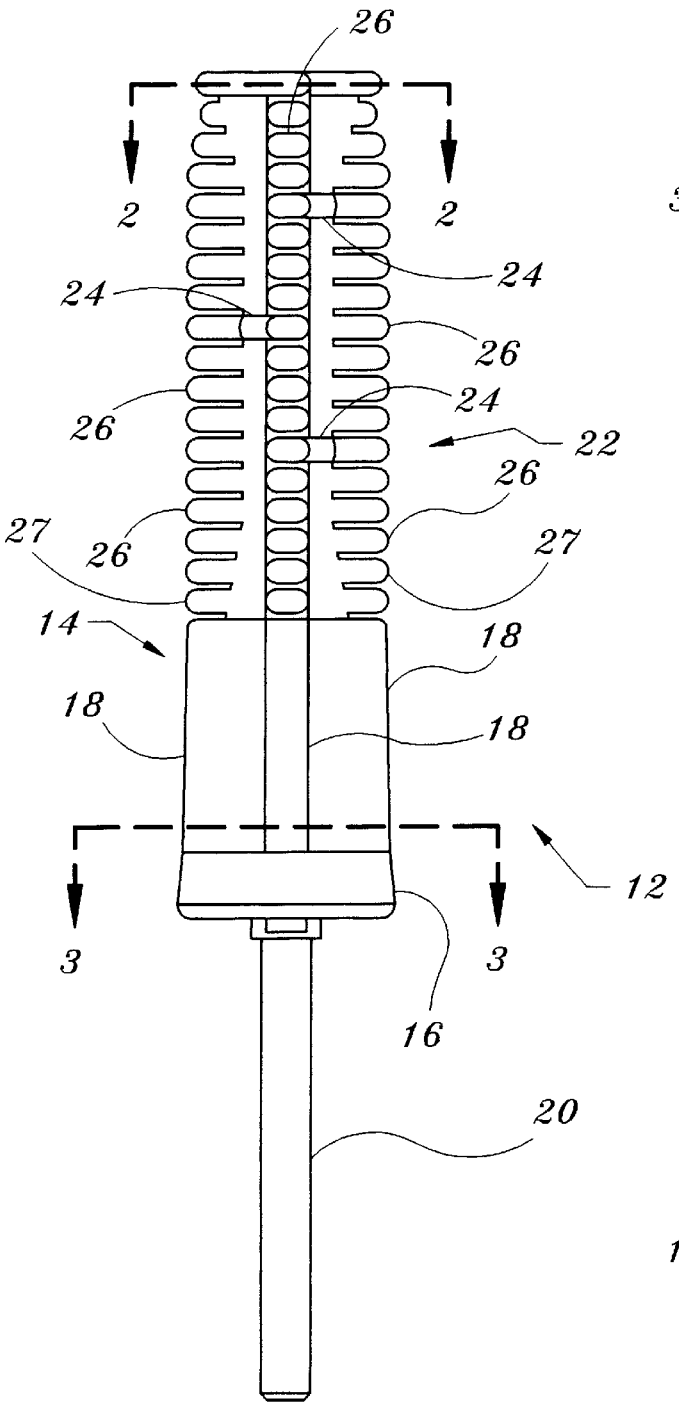
FIG. 1 is a front view of a paint brush and paint roller cleaning tool produced in accordance with the preferred embodiment of the present invention.

A novel approach to solving these problems is shown in FIG. 1 which shows a tool 12 for supporting a paint brush or a paint roller. The tool 12 includes a base 14 which may be cylindrical in shape or as shown her with a cylindrical portion 16 and four concentricity located ribs 18. From one end of the base 14 extends an attachment means or attachment rod 20. This rod 20 is shown here to be the shape of a smooth cylinder, but the shape and texture is not important to the use of the invention. The attachment rod 20 is to be inserted into the chuck of a drill, manual spinner (as in U.S. Pat. No. 5,588,221), air powered drill or other device that provides rotary motion. As such, the surface of the attachment rod can be knurled or smooth, and the shape at any section could be round, square, hexagonal or other polygonal shapes. All that matters is that it can be received and secured by the device to provide rotary motion.

From the other end of the base extends four flexible body extensions 22 that are held together by a series of ring segments 24. The number of body extensions 22 are not critical to the function of the invention and are shown here comprising four elements because that is what the applicants have determined to be optimal. The tool 12 will work with as few as two extensions or as many as could be conceivably manufactured. The body extensions 22 are made of a pliable material to allow them to flex. This is done for two reasons. First, the flexible nature is important in that the extensions 22 define a cavity there between. This cavity is suited for receiving the handle of a paint brush. Paint brush handles vary in size and shape, thus the pliable nature of the extensions allow them to flex relative to the shape of the handles.

The ring segments 24 connect the extensions 22 preferably at several places along the longitudinal dimension of the extension, as shown here. The ring segments 24 are shown here to not provide a continuous annular ring but a series of broken rings that are displaced along the extensions 22. This allows for greater flexibility of the extensions 22 to conform to the often curved shaped handles of paint brushes or to the simple thin cylindrical shaped handles. The ring segments 24 supply axial force to the handle to hold it securely within the cavity defined by the extensions 22. Though the orientation of the ring segments 24 has been determined preferably to not be continuous annular rings, such an arrangement is also possible and could in some circumstances be preferable. An example of such is further disclosed herein.

The second purpose to the pliable nature of the body extensions 22 is that the body has the capability to flex from side to side. In this figure, one method of restricting the extent of side flexion of the body extensions 22 is shown by the use of flex limiters 26. These are protrusions along the extensions, the protrusions oriented orthogonal to the long axis of the extensions 22 with small gaps between the limiters 26. The limiters 26 allow deflection until the edges of these protrusions contact each other, thus limiting the range of the deflection in that direction. Closer to the base 14 lower limiters 27 are shown. These can be seen to be shorter that the limiters 26. This is because the body extensions 22 are thicker closer to the base 14. This is not necessary to the novelty of the invention but it does provide added strength to the material in this area, where flexure of the extensions 22 does occur. It can be seen why four extensions are preferable though three would also be functional. Two would work but the flex limiters 26 would need to be very wide to support flexion in all directions. This excessive width could present molding difficulties, in that molding is the likely preferred manufacturing process of much of the invention.

Figure 2:
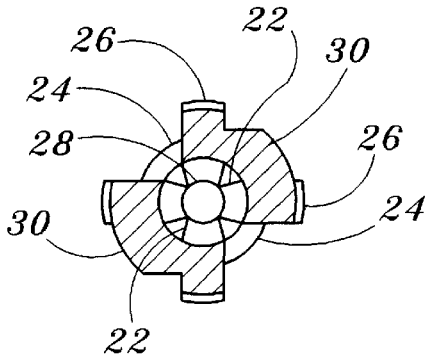
FIG. 2 is a sectioned view along line 2—2 of a paint brush and paint roller cleaning tool produced in accordance with the preferred embodiment of the present invention.

A section along line 2—2 is shown in FIG. 2. Here the four body extensions 22 can be seen with the four limiters 26. The cavity 28 defined by the extensions 22 is also more distinctly shown. The ring segments 24 along the body extensions 22 are shown here as they are in the preferred embodiment, whereas the section shows the top edge comprising a thick ring 30 that connects each of two pair of the extensions 22. Functionally these are similar in many ways but the surface created by the outer edges of the thick rings 30 acts as a stop and support for brushes that are inserted into the tool 12 as well as a hand hold to aid in inserting the brushes. Though desirable, this added area is not necessary for the device.

Figure 3:
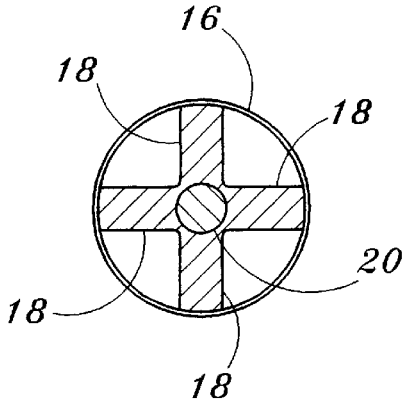
FIG. 3 is a sectioned view along line 3—3 of a paint brush and paint roller cleaning tool produced in accordance with the preferred embodiment of the present invention.

The section along line 3—3 is shown in FIG. 3. As previously mentioned, the base can be entirely made of a cylindrical or conical structure. To make this structurally sound, ribs would typically be placed inside to support the wall from external forces. The function of the base is to support the other elements but the majority of the length of the base is to support a paint roller placed thereon. As such, the most efficient method is to use the ribs 18 alone to support the roller. Three ribs would support a roller, here four are shown, but the number could be used, from three to infinity. An infinite number would constitute an endless, thereby solid or cylindrical base. In order to make the interaction of the base 14 and the attachment rod 20 more secure and given the differences in performance requirements of the base 14 and the rod 20, the rod is preferably manufactured of metal, such as steel or aluminum and insert molded in the base 14 which is likely a thermoplastic or synthetic rubber that is not deteriorated by solvents. Thus, the rod 20 extends through a portion of the base, as is shown in this view.

Figure 4:
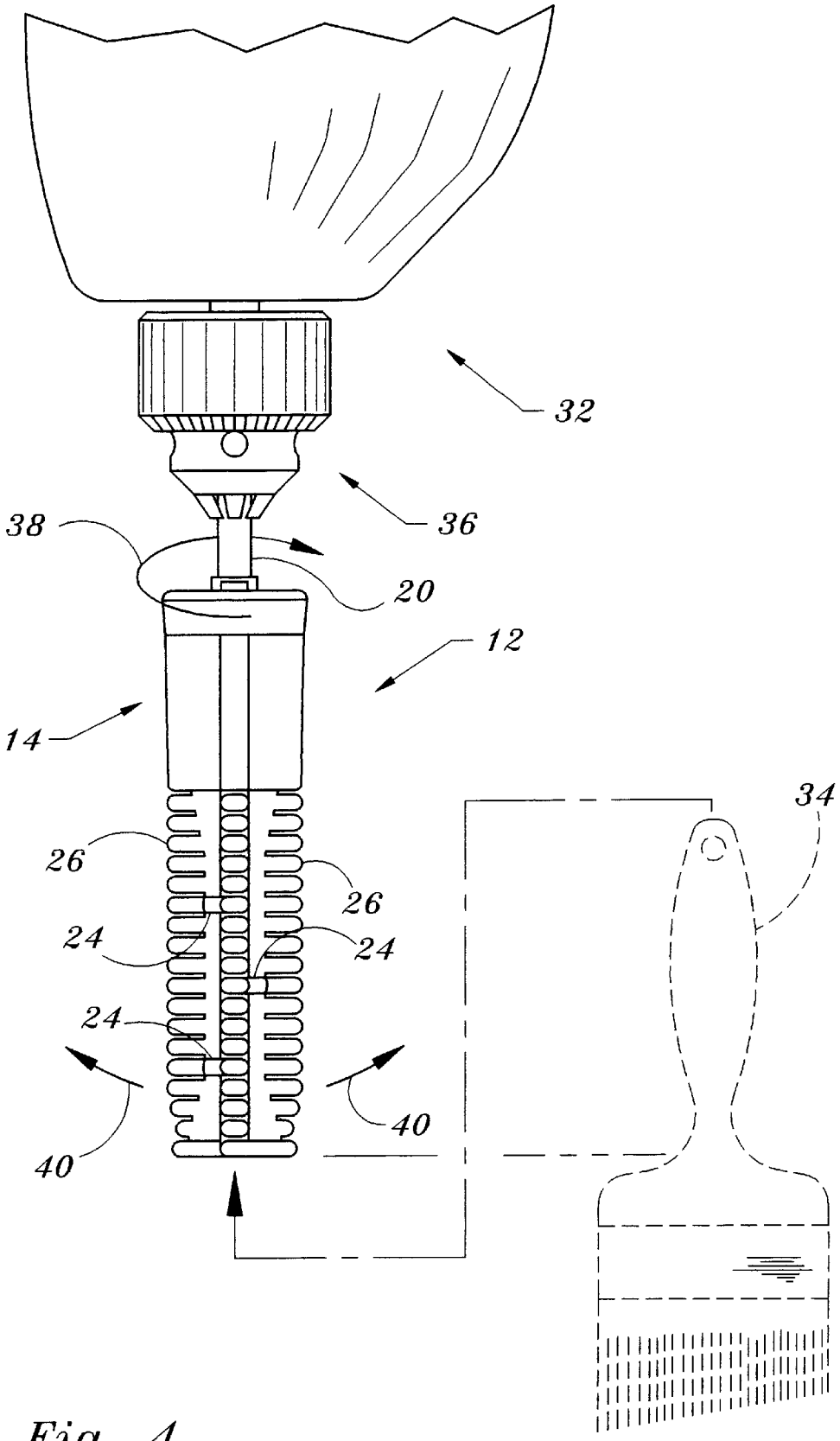
FIG. 4 is a front view of a paint brush and paint roller cleaning tool positioned in a drill chuck used with a paint brush, the tool produced in accordance with the preferred embodiment of the present invention.

A typical application of the device is shown in FIG. 4 which includes a drill 32 and an item to be cleaned or dried, here a brush 34. The tool 12 is inserted into the drill 32 by inserting the attachment rod 20 into the chuck 36 of the drill 32. The brush 34 is inserted into the cavity of the tool 12, the handle positioned, as shown here, with the distance inserted being the relative distance in the tool 12 as is the brush 34 shown outside the tool 12. The tool 12 and secured brush 34 are then able to be rotated, as provided by the drill 32. As a side note, this typical flared handle on the brush 34 illustrates the usefulness of the noncontinuous ring segments 24, thus allowing for great distortion of portions of the extensions while maintaining the ability to receive and secure the handle of the brush 34.

Upon rotation of the tool 12, as shown by the upper arrow 38 any net eccentric load placed on the tool 12 itself or through the brush 34 placed therein, would place a side load on the tool 12, causing it to flex as it revolves. This load can be as subtle as the force of gravity on the invention when it is not perfectly vertical when rotated, or the forces applied through slight movements when rotated in a liquid solvent. This side load results in flexion of the tool.

The flexion is limited by the flex limiters 26 that are positioned along the length of the extensions, thus allowing the same restriction regardless of the depth of insertion of the brush in the cavity. This flexion is depicted by the lower arrows 40. The resulting flexion while rotating would create a circular pattern in the third dimension. This rotation and translation or "orbiting" provides a constant movement of the brush as it rotates. A rigidly rotating brush has the center of rotation passing constantly through a portion of the brush. When the center of rotation is consistently on or near some bristles, there is very little centrifugal force applied to any debris on those bristles. This force is necessary to dislodge the paint and debris particles from those bristles to clean and dry the brush. Thus, whether cleaning the bristles in a liquid solvent or drying them by rotating them in the air, a device with a singular, stationary center of rotation on the brush will not completely dislodge the paint or moisture. This is especially important in cleaning the paint out of the heal of the brush, near the base of the bristles. Translation during rotation solves this problem by orbiting the bristles about the center of rotation as they rotate. With a high speed drill driving the invention, a brush can be cleaned and dried in just a few seconds.

This translation during rotation is not necessary for a paint roller supported on the base 14 because the paint roller is hollow and therefore particles do not need to be removed from the roller about the center of rotation. As such, the base 14 can be substantially rigid and not flex during rotation.

Figure 5:
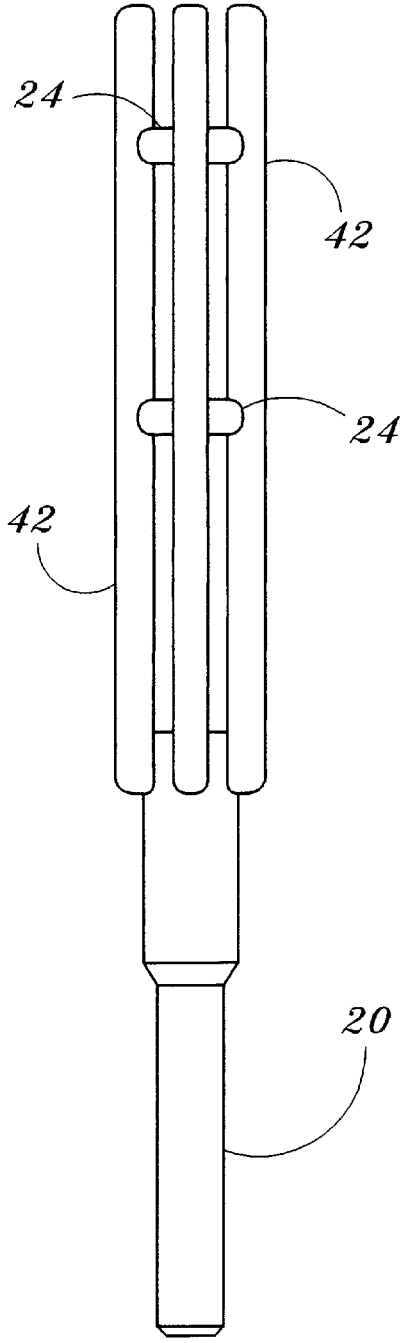
FIG. 5 is a front view of a paint brush and paint roller cleaning tool produced in accordance with an alternative to the preferred embodiment of the present invention.

A variation to the preferred embodiment is shown in FIG. 5 in which the attachment rod 20 is similar to that previously described and the extensions 42 function similar to the base extensions, as previously disclosed, only without the flex limiters. The ring segments 24 are shown in this view to be continuous and could be if such elements were made of a pliable material with enough elastic memory to drastically extend without failing, or only used with brushes that have substantially cylindrical handles. The device would function the same as previously disclosed only without a limit on the amount of lateral flexion during rotation. This device is also not suited for use with a paint roller.

Figure 6:
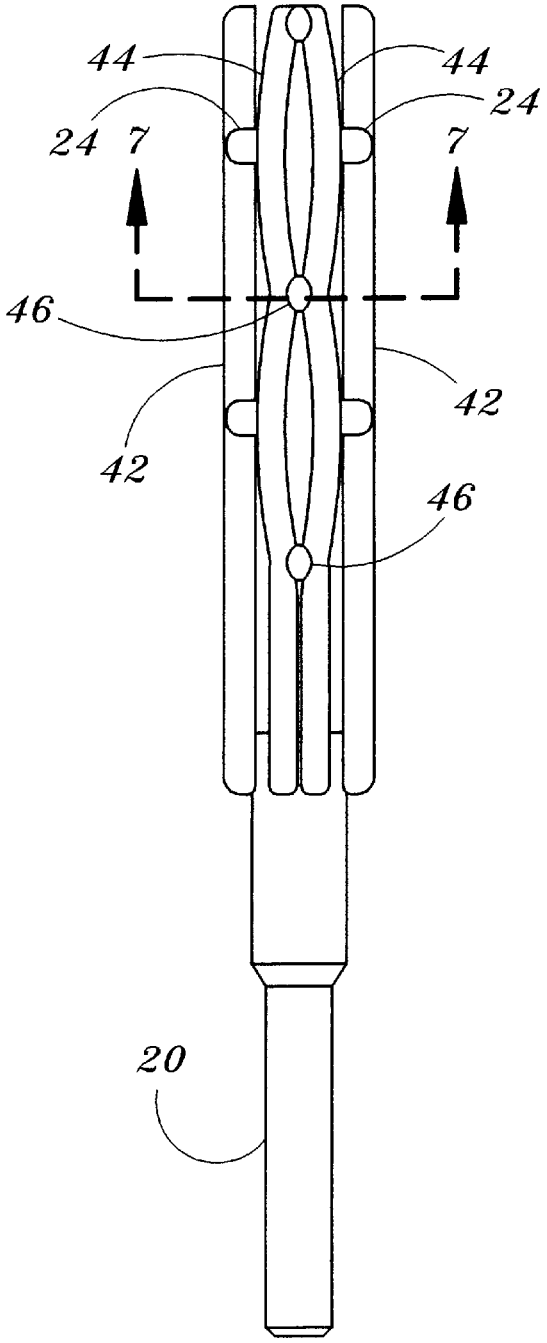
FIG. 6 is a side view of the paint brush and paint roller cleaning tool shown in FIG. 5, the tool produced in accordance with an alternative to the preferred embodiment of the present invention.

Overcoming the need for expansion of the extensions for large brush handles is illustrated in FIG. 6, this figure being a side view of the tool in FIG. 5. Here the extensions 42 are connected on each side by a set of bowed extensions 44 which are connected to the extensions 42 by the ring segments 24. These are shown here to not be continuous annular rings but rings that are absent between the extensions 42. The bowed extensions 44 are joined by the connections 46, these connections 46 being in a different plane than the ring segments 24 thus allowing for more dramatic distortion of the combination of extensions to accept various handles.

Figure 7:
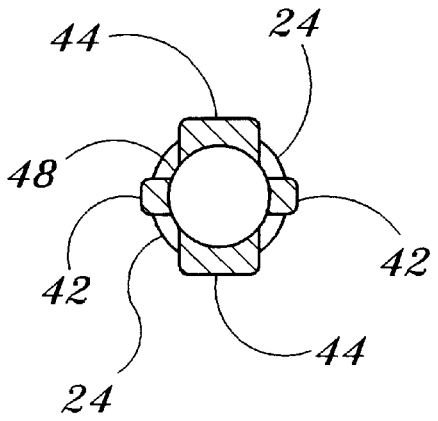
FIG. 7 is a sectioned view along line 7—7 of a paint brush and paint roller cleaning tool produced in accordance with an alternative to the preferred embodiment of the present invention.

The section of the previously stated version of the invention being cut along line 7—7 is shown in FIG. 7. This shows the position of the cavity 48 for receiving a paint brush handle, the cavity 48 being defined by the extensions 42 and the bowed extensions 44, the section passing through the bowed sections at the connections 46.

Figure 8:
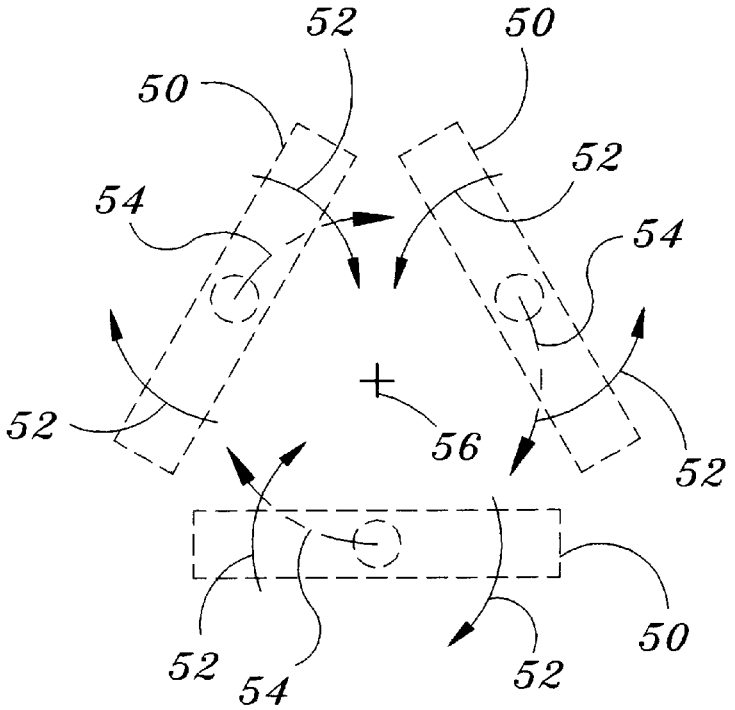
FIG. 8 is a top view of a typical path of motion of a paint brush as it rotates and orbits being used with the paint brush and paint roller cleaning tool produced in accordance with the preferred embodiment of the present invention.

What is shown in FIG. 8 is a diagram of top view of a paint brush 50 as it is rotating and translating, thus causing the orbiting motion as previously disclosed. The small arrows 52 show the rotation of the brush 50 and the large arrows 54 show the rotation or orbit of the brush as it moves about the center mark 56. This "orbiting" is due to the translation of the brush 50 from forces applied during the rotation and allowed by the pliant nature of the extensions of the tool. This top view shows the brush 50 in three positions of the one orbit as it would be rotating. This is only a graphic depiction. The radius of the orbit and the positions of the brush 50 during any position are not critical to the scope of the invention.

Figure 9:
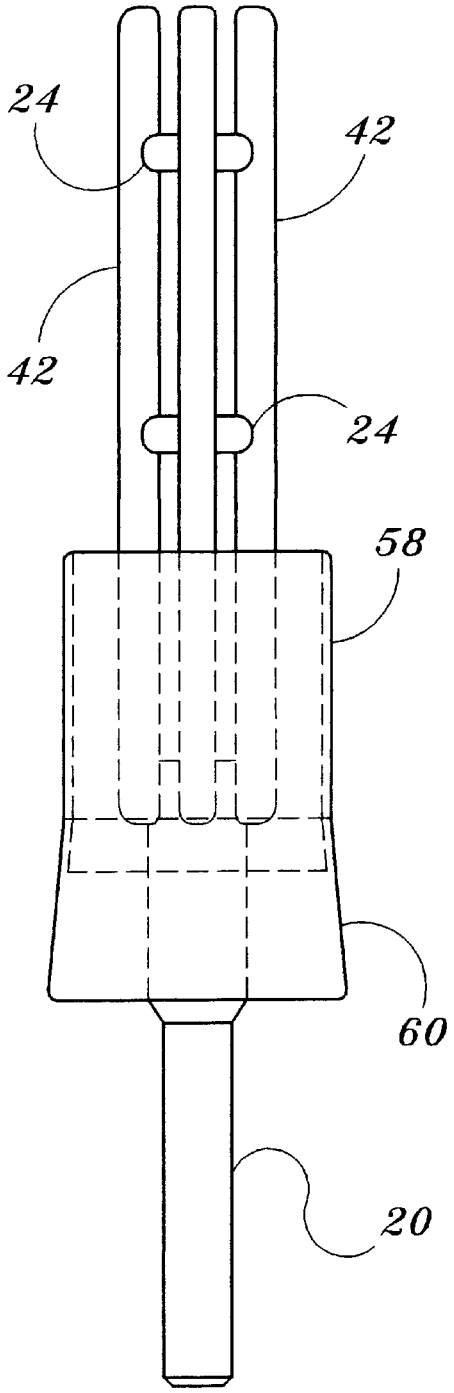
FIG. 9 is a front view of a paint brush and paint roller cleaning tool utilizing a flexion limiting roller sleeve, the tool produced in accordance with an alternative to the preferred embodiment of the present invention.

Another version of the invention is shown in FIG. 9 with a modification to limit the flexion of the extensions 42 and with a cylindrical hollow base 58 to receive a paint roller. Again the general function of the invention is the same as previously mentioned and shown in FIGS. 5, 6 and 7. Here the ring segments 24 limit the deflection of the extensions 42 from one another. The hollow base 58 includes a tapered base portion 60 which allows for the inside portion of a paint roller to be releasably secured thereon. This tapered feature is also included with the previously disclosed ribbed base as shown in FIG. 1. The angle of the taper is not critical to the scope of the invention but the applicants have determined the optimal angle to be between two and ten degrees. Also, as before, an attachment rod 20 is included to be received by a drill or other device to provide rotary motion.

Figure 10:
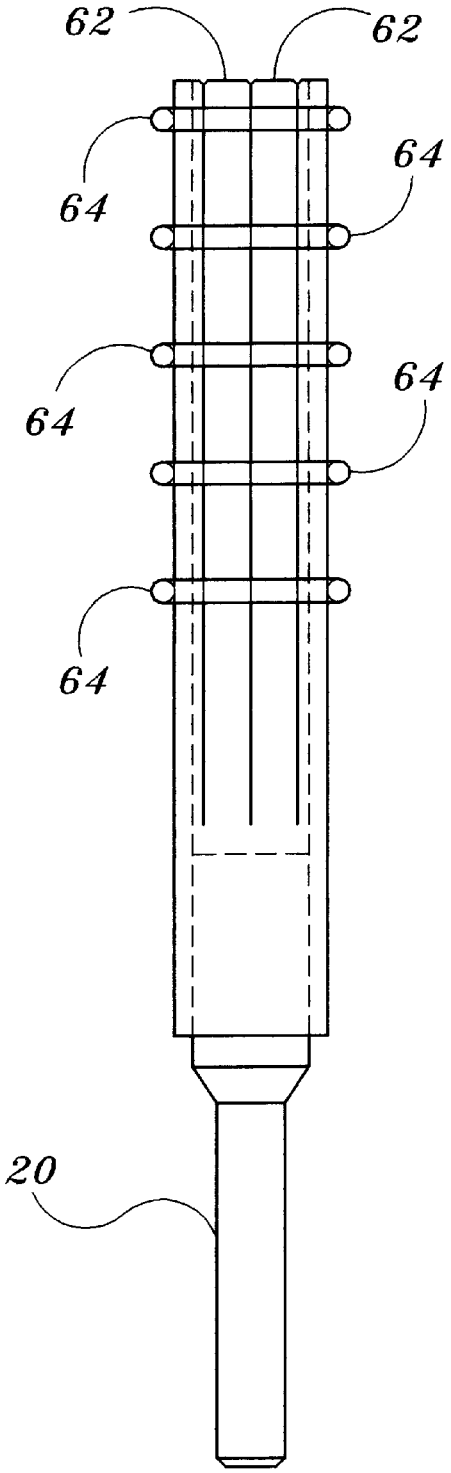
FIG. 10 is a front view of a paint brush and paint roller cleaning tool produced in accordance with an alternative to the preferred embodiment of the present invention.

Another variation to the preferred embodiment is shown in FIG. 10. Here extension slats 62 are positioned in an annular arrangement about a central axis. The extension slats 62 are likely slightly more rigid than those previously disclosed with a series of annular elastic rings 64 applying tension in the direction of the central axis. As a brush handle is inserted into the cavity defined by the annular extension slots 62, they flex to somewhat change shape to conform to the handle but also they are displaced. The elastic rings 64 provide the necessary tension to the brush handle to secure it within the tool. A ribbed or hollow base could be added to make this or any of the other versions of the invention adaptable to support a paint roller. The attachment rod 20, as before, is used to rotate the tool and painting utensil to cause rotary motion as well as a translation to insure complete cleaning of the utensil.

What is claimed is:

1. A painting utensil cleaning adapter comprising:

a base with a first end and a second end, the base being capable of being received by one end of a paint roller, releasably securing thereto;

an attachment means extending from said second end of said base, the attachment means including an end that is receivable by a means of providing rotary motion;

at least two substantially longitudinal flexible body extensions projecting from said first end of said base, the body extensions defining an internal cavity there between; and a plurality of ring segments connecting said body extensions, whereby a handle of a paint brush can be received by said internal cavity, the flexible body extensions conforming to the shape of the handle and the ring segments releasably securing the handle within the cavity and rotated via the attachment means by the means for providing rotary motion, thus providing centrifugal force to remove debris from the bristles of the brush or the paint roller releasably secured to said base.

2. The painting utensil cleaning adapter as described in claim 1, further comprising a plurality of flex limiters located on said flexible body extensions the flex limiters providing a mechanical limit to the deflection of said body extensions.

3. The painting utensil cleaning adapter as described in claim 1, wherein said ring segments include tensile elastic properties enabling said flexible body extensions to be displaced and grip an object received in said internal cavity.

4. The painting utensil cleaning adapter as described in claim 3, wherein said ring segments attach the adjacent edges of said flexible body extensions.

5. The painting utensil cleaning adapter as described in claim 4, wherein said ring segments attach the adjacent edges of said flexible body extensions such that the rings segments do not form a continuous annular ring about the body extensions.

6. The painting utensil cleaning adapter as described in claim 3, wherein said ring segments are comprised of a plurality of annular rings disposed about the perimeter of said flexible longitudinal body.

7. The painting utensil cleaning adapter as described in claim 1, wherein the base is comprised of a plurality of concentric ribs.

8. The painting utensil cleaning adapter as described in claim 7, wherein said concentric ribs are comprised of a four equal protrusions located orthogonal and equidistant to each adjacent protrusion.

9. The painting utensil cleaning adapter as described in claim 1, wherein said base includes a taper such that the outside dimension of the base near said second end is greater than the outside dimension near the first end, whereby a hollow item such as a paint roller can be releasably secured to the base by wedging it onto the tapered base.

10. The painting utensil cleaning adapter as described in claim 9, wherein said taper is a taper between 0.5 and 10 degrees.

11. A painting utensil cleaning adapter comprising:

a plurality of flexible substantially longitudinal extensions disposed annularly about and connected to a base support, the extensions defining an internal cavity there between that is capable of receiving a handle of a paintbrush;

a plurality of ring segments connected to at least two of said extensions, the ring segments restricting movement of said extensions away from another extension; and an attachment means secured to said base support, the attachment means being capable of transmitting torsional load through said base support to said longitudinal extensions, whereby a handle of a paint brush can be secured in said internal cavity with the bristles exposed and with a means for providing rotational movement driving the attachment means, the secured brush rotates and translates about the axis of rotation provided by the means for providing rotational movement, the translation due to flexion of said longitudinal members during the rotation, thus causing centrifugal force on all bristles of the brush, cleaning same.

12. The painting utensil cleaning adapter as described in claim 11, further comprising a tapered base secured to said base support, the tapered base extending away from said attachment means forming an annular ring about a portion of said longitudinal members, thus limiting the deflection of said longitudinal members.

13. The painting utensil cleaning adapter as described in claim 11, wherein said ring segments include tensile elastic properties enabling said flexible body extensions to be displaced and grip an object received in said internal cavity.

14. The painting utensil cleaning adapter as described in claim 13, wherein said ring segments attach the adjacent edges of said flexible body extensions.

15. The painting utensil cleaning adapter as described in claim 14, wherein said ring segments attach the adjacent edges of said flexible body extensions such that the rings segments do not form a continuous annular ring about the body extensions.

16. The painting utensil cleaning adapter as described in claim 13, wherein said ring segments are comprised of a plurality of annular rings disposed about the perimeter of said flexible longitudinal body.

17. The painting utensil cleaning adapter as described in claim 11, wherein said tapered base includes a taper such that the outside dimension of the tapered base near said base support is greater than the outside dimension near the opposite end, whereby a hollow item such as a paint roller can be releasably secured to the base by wedging it onto the tapered base.

18. The painting utensil cleaning adapter as described in claim 17, wherein said taper is a taper between 0.5 and 10 degrees.

19. A method of cleaning paint brushes including the steps of:

providing a substantially longitudinal adapter including at least two flexible portions, thereby defining an internal cavity;

providing a means of enabling rotary motion which is capable of being secured to said adapter;

providing a container at least partially filled with a solvent;

inserting the handle of a paint brush into said internal cavity, leaving the bristles of the brush exposed;

inserting the bristles of the brush into the solvent;

rotating said adapter and brush secured thereto by employing said means of enabling rotary motion while said at least two flexible portions enable lateral movement of the brush while rotating, thereby eliminating any bristle from consistently lying about the center of rotation thus;

allowing centrifugal force to be applied to the paint or other debris on all the bristles of said brush, thoroughly cleaning same.

20. The method of cleaning paint brushes as described in claim 19, wherein said providing a means of enabling rotary motion includes the use of a device selected from the group consisting of a manual spinner, and electric drill and an air drill.

* * * * *